US007726459B2

(12) United States Patent
Jayachandran et al.

(10) Patent No.: US 7,726,459 B2
(45) Date of Patent: Jun. 1, 2010

(54) PASSENGER CONVEYOR STEP HAVING AN ACOUSTIC BARRIER

(75) Inventors: Vijay Jayachandran, Vernon, CT (US); Goldino Alves, South Windsor, CT (US); Dave Jarvis, West Hartford, CT (US); Fred Spielman, Somers, CT (US)

(73) Assignee: Otis Elevator Company, Farmington, CT (US)

( * ) Notice: Subject to any disclaimer, the term of this patent is extended or adjusted under 35 U.S.C. 154(b) by 586 days.

(21) Appl. No.: 11/570,464

(22) PCT Filed: Jul. 8, 2004

(86) PCT No.: PCT/US2004/022193

§ 371 (c)(1),
(2), (4) Date: Dec. 12, 2006

(87) PCT Pub. No.: WO2006/016873

PCT Pub. Date: Feb. 16, 2006

(65) Prior Publication Data

US 2007/0175730 A1 Aug. 2, 2007

(51) Int. Cl.
*B66B 23/12* (2006.01)

(52) U.S. Cl. ..... 198/333; 198/326

(58) Field of Classification Search ..... 198/326–333
See application file for complete search history.

(56) References Cited

U.S. PATENT DOCUMENTS

| | | | | |
|---|---|---|---|---|
| 4,519,490 | A | 5/1985 | White | |
| 4,858,745 | A | 8/1989 | Haas et al. | |
| 5,186,301 | A | 2/1993 | Rivera | |
| 5,284,237 | A * | 2/1994 | Mello et al. | 198/335 |
| 5,452,789 | A | 9/1995 | Wolpers et al. | |
| 5,924,544 | A | 7/1999 | Kwon | |
| 6,234,295 | B1 | 5/2001 | Ogawa | |
| 6,241,071 | B1 | 6/2001 | Yamashita et al. | |
| 6,585,099 | B2 * | 7/2003 | Babler et al. | 198/333 |
| 6,702,094 | B2 | 3/2004 | Ishikawa et al. | |
| 2007/0170038 | A1 * | 7/2007 | Howard et al. | 198/333 |

FOREIGN PATENT DOCUMENTS

| | | |
|---|---|---|
| GB | 505409 | 5/1939 |
| JP | 08-048482 | 2/1996 |
| JP | 2001-247285 | 9/2001 |

OTHER PUBLICATIONS

International Search Report for International Application No. PCT/US04/22193 mailed Feb. 2, 2006.
Written Opinion of the International Searching Authority for International Application No. PCT/US04/22193 mailed Feb. 2, 2006.
Supplementary European Search Report for Application No. EP 04 75 6873 mailed Apr. 9, 2009.

* cited by examiner

*Primary Examiner*—Mark A Deuble
(74) *Attorney, Agent, or Firm*—Carlson, Gaskey & Olds PC

(57) ABSTRACT

An escalator step (12) includes a sound barrier material (40) covering over at least a portion of an inner surface (42) of a tread portion(30) and an inner surface (44) of a rise portion (32). In one example, the sound barrier material (40) comprises a sheet of vinyl. The sound barrier material (40) reduces noise radiation from the step (12) toward a cavity (26) within a passenger conveyor support structure (20) and reduces noise emanations from the cavity (26) through the steps (12). Several embodiments for securing the sound barrier material (40) in place are disclosed.

24 Claims, 4 Drawing Sheets

Fig-3
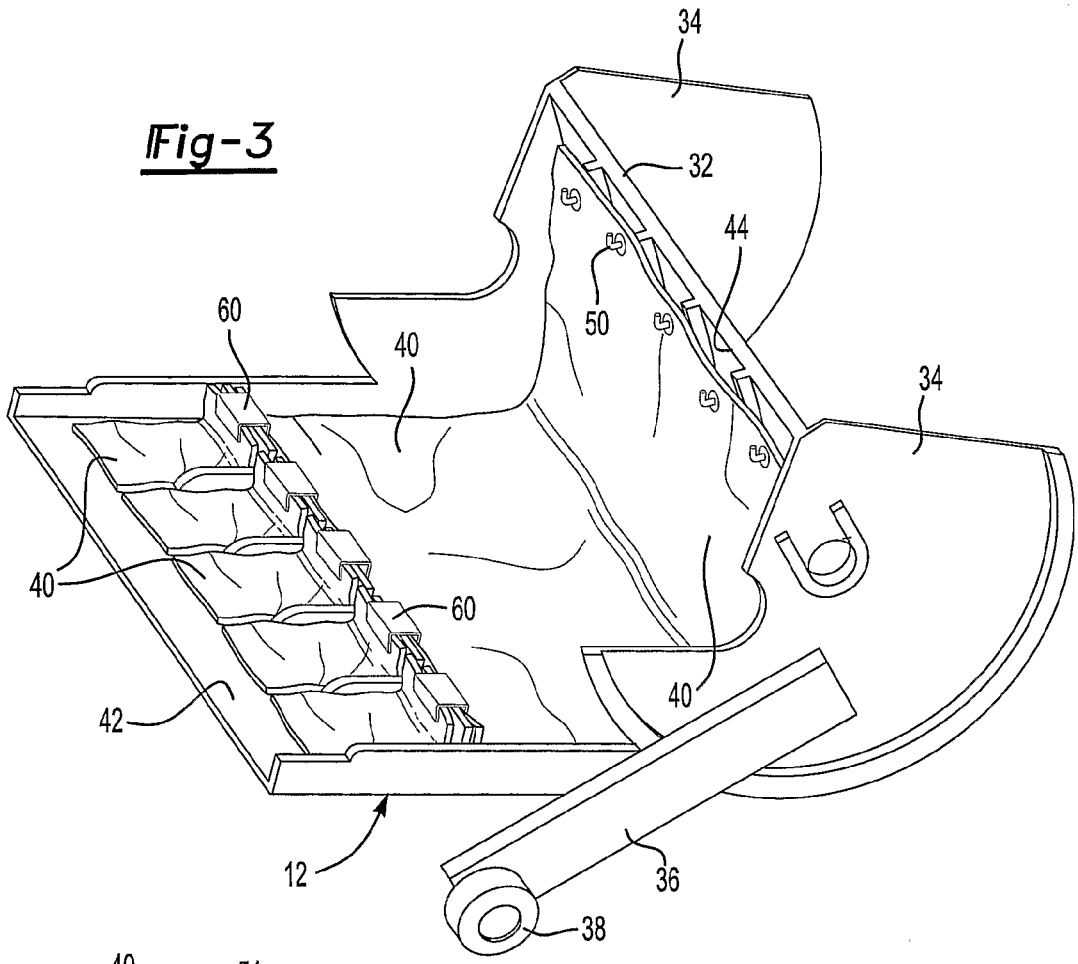
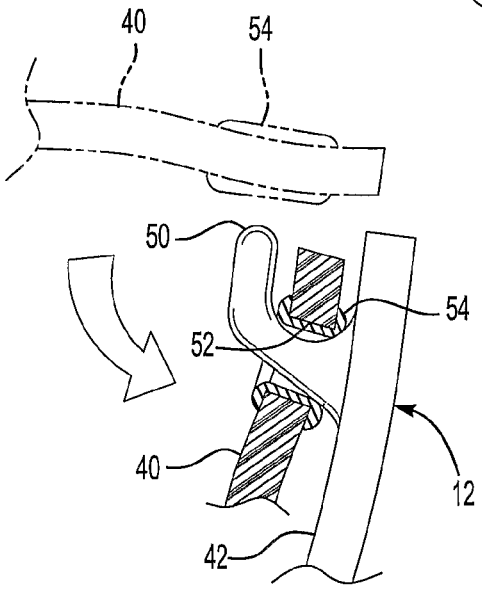
Fig-4A
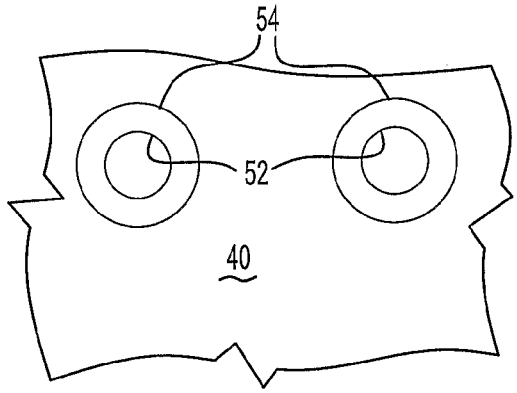
Fig-4B

PASSENGER CONVEYOR STEP HAVING AN ACOUSTIC BARRIER

FIELD OF THE INVENTION

This invention generally relates to passenger conveyors More particularly, this invention relates to controlling sound emissions associated with a passenger conveyor system.

DESCRIPTION OF THE RELATED ART

Passenger conveyors, such as escalators, typically include a plurality of steps that travel around a loop for carrying passengers between landings, which may be located at different levels of a building, for example. The steps follow a track that defines the loop such that some of the steps face in a direction for carrying a passenger while other steps are in a return loop typically beneath a visible surface. Most passenger conveyors include a step chain that is driven by a machine (i.e., motor and brake arrangement) and the steps move with the step chain.

In typical arrangements, the machine has been located at or beneath one of the landings. This location has made it possible for providing an insulated structure around the machine that is useful for reducing sound emissions from the machine into an area where people may hear the noises of the machine. More recently, escalator systems have been introduced that include positioning the machine along the rise of the escalator. Such a position of the machine makes it possible for noises associated with the machine to be reverberated within the cavity of the support structure that supports the loop of steps. Further, the sounds of the machine may emanate outward from beneath the steps and be heard by passengers on the conveyor. It is not easy to provide an insulated structure along the rise of an escalator as it was possible beneath a landing, for example. There is a need for an arrangement that reduces the possibility of machine sounds from being heard by individuals on or in the vicinity of the conveyor.

Other moving parts of the conveyor system are possible sources of noise. In one example system, the steps follow along a track where rollers directly engage the track without any lubricant. Eliminating lubricant has recognized benefits from an environmental standpoint, however, the absence of lubricant increases the possibility for additional noise generation. It becomes more likely that vibrations associated with the rollers following the track will be transferred to the steps resulting in noise emanating from the steps toward the cavity within the support structure. There is a need for an arrangement that will reduce the possibility for noises emanating from steps into the cavity to avoid having such noises reverberate within the cavity and eventually be heard by an individual on the conveyor or in the vicinity of it.

Several proposals have been made for controlling sound or noise associated with passenger conveyor systems. U.S. Pat. No. 5,284,237 discloses an arrangement where sound insulation is associated with a balustrade. Another arrangement is shown in the Japanese Publication No. 08-048482 where a cover member associated with the outside of a passenger conveyor truss includes a sound absorbing member. The Japanese Publication No. 2001-247285 discloses another arrangement where a side portion of a step includes a sound absorbing material packed within reinforcement parts on the sides of the step. One shortcoming of all of these arrangements is that they do not address the situation where sound may emanate from an underside of a step toward a cavity within the conveyor support structure arrangement. Further, such arrangements do not address the situation where sound emanations may come from the cavity through the steps in a generally upward direction.

U.S. Pat. No. 6,241,071 discloses an arrangement for making a passenger conveyor step using a plastic material. One disclosed embodiment in that document includes a tread reinforcing substrate filled with foam for reducing sound transmissions through the tread portion.

There still is a need for adequately addressing noise control for escalator systems. In particular, there is a need for an arrangement that reduces sound transmissions from the steps toward the cavity within the conveyor support structure arrangement. Additionally, there is a need for effective sound control to prevent noises emanating from within the cavity out to where a passenger or individual in the vicinity of the conveyor may hear them. This invention addresses those needs.

SUMMARY OF THE INVENTION

An exemplary disclosed embodiment of a passenger conveyor step includes a tread portion that has an outer surface adapted to face toward a passenger and an inner surface facing in a generally opposite direction from the outer surface. A riser portion extends away from the tread portion and has an outer surface and an inner surface. A sound barrier material covers at least some of the inner surface of the tread portion and at least some of the inner surface of the riser portion.

An example method of controlling sound emissions associated with a passenger conveyor includes covering inner surfaces of steps with a sound barrier material to thereby reduce sound radiation from the steps into the cavity within the conveyor support structure. Further, this bander material prevents transmission of noise from the cavity to the passenger.

In one example, the sound barrier material covers substantially all of the inner surfaces. One example sound barrier material comprises at least one sheet of vinyl. In another example, the sound barrier material comprises a composite of acoustic foam and vinyl or similar barrier material.

The various features and advantages of this invention will become apparent to those skilled in the art from the following detailed description of currently preferred embodiments. The drawings that accompany the detailed description can be briefly described as follows.

BRIEF DESCRIPTION OF THE DRAWINGS

FIG. 3 is a perspective illustration of an opposite side of the step shown in FIG. 2.

FIG. 4A is a side view schematically showing one example arrangement of securing an acoustic barrier to a portion of a passenger conveyor step.

FIG. 4B is a plan view of the acoustic barrier from FIG. 4A.

DETAILED DESCRIPTION OF THE PREFERRED EMBODIMENTS

Figure 1:
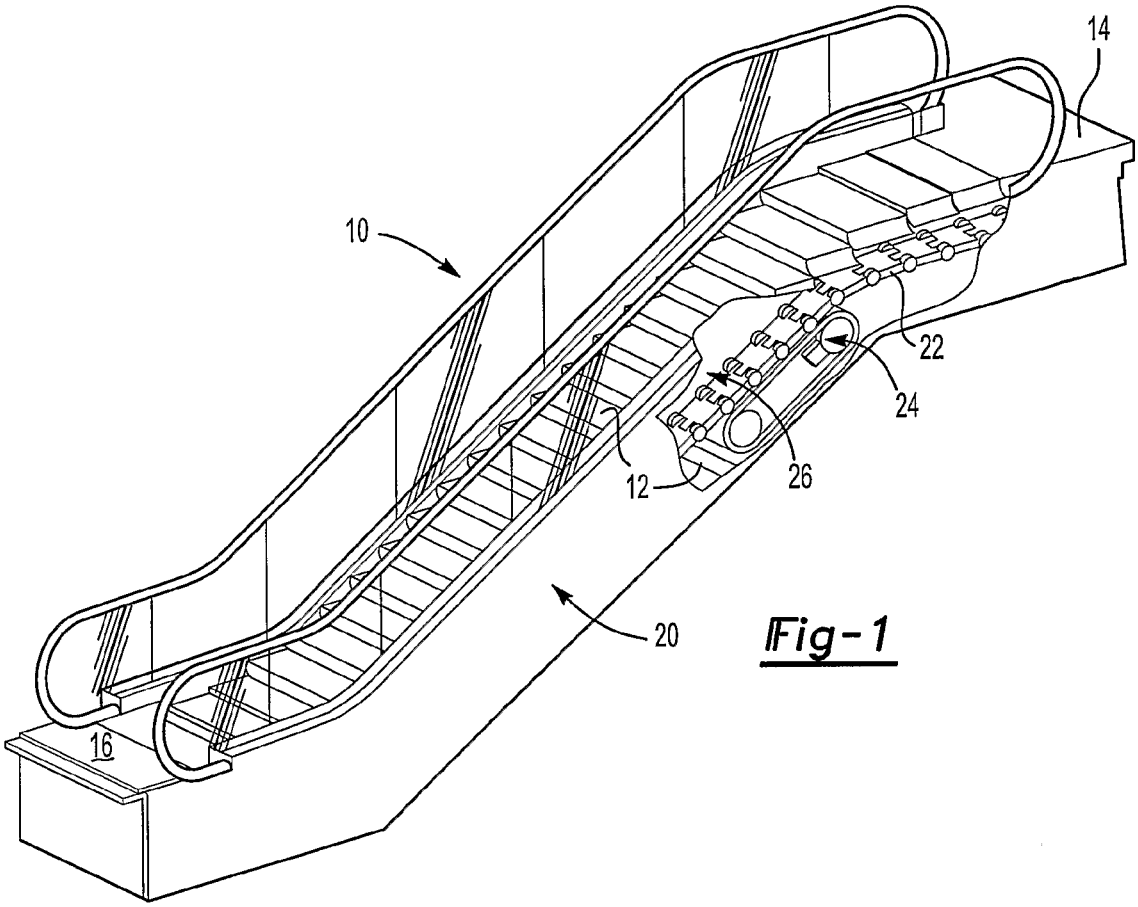
FIG. 1 schematically illustrates an example passenger conveyor system.

FIG. 1 schematically shows a passenger conveyor system 10 that includes a plurality of steps 12 for carrying passengers between landings 14 and 16. The illustrated conveyor system 10 is an escalator, which is one example type of passenger conveyor. This invention is not necessarily limited to such an arrangement.

The example of FIG. 1 includes a support structure 20 within which the steps 12 follow a loop in a generally known manner to provide continuous movement of steps between the landings 14 and 16. In the illustrated example, a step chain 22 is associated with the steps 12 and is driven by a machine 24. In this example, the machine 24 includes a motor and brake assembly that is supported in the rise portion of the support structure 20. The machine 24 propels the step chain 22, which results in the desired movement of the steps 12.

There is a cavity 26 within the loop of steps 12 and within the support structure 20. The presence of the machine 24 along the rise portion introduces the possibility for machine noises to reverberate within the cavity 26, to emanate out through the steps 12 or both so that they are heard in the vicinity of the conveyor system 10.

Figure 2:
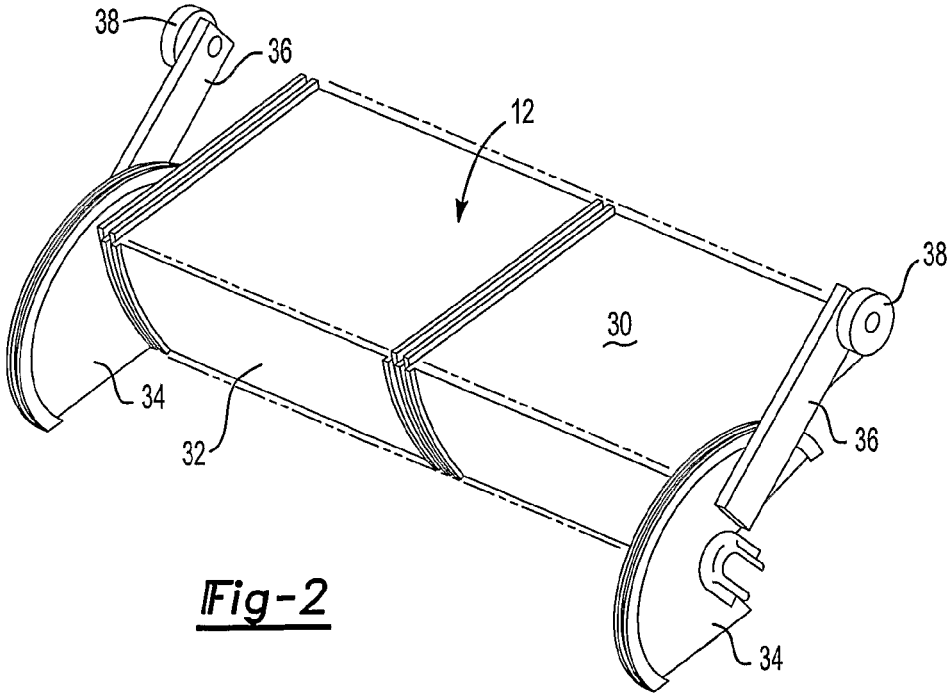
FIG. 2 is a perspective illustration of a step designed according to an example embodiment of this invention.

An example step design is shown in FIGS. 2 and 3. The illustrated step 12 includes a tread portion 30 having an outer surface that faces generally upward (according to FIG. 1) for receiving the foot of a passenger, for example. A riser portion 32 includes an outer surface as known.

The example step 12 has side shirt portions 34 from which extend support arms 36. Rollers 38 are supported at distal ends of the support aims 36. The rollers 38 follow a track (not illustrated) that is supported within the support structure 20 such that the steps 12 follow the desired loop.

In one example, no lubrication is used between the rollers 38 and the track. In such an example, vibrations associated with roller movement along the track may be transferred to the step structure resulting in noise emanating from the steps 12 toward the cavity 26.

FIG. 3 shows an underside or inner side of the example step 12 including a sound barrier material 40 covering a substantial portion of an inner surface 42 of the tread portion 30 and an inner surface 44 of the riser portion 32. The inner surfaces 42 and 44 face toward the cavity 26 during operation of the conveyor system 10.

The sound barrier material 40 reduces noises heard in the vicinity of the conveyor system 10 by reducing sound radiation from the steps 12 into the cavity 26. The sound barrier material 40 also reduces sound transmissions from within the cavity 26 out through the steps 12 into an area where an individual may hear such noises.

The sound barrier material 40 in one example comprises a sheet of acoustic barrier material such as vinyl. Acoustic barrier materials that are known as "dead" materials (i.e., heavy and limp) are preferred and those skilled in the art who have the benefit of this description will be able to select from such materials to meet the needs of their particular situation. One example material is vinyl. A dead acoustic barrier material that is heavy and limp provides an effective barrier for reducing noise radiation from the steps into the cavity 26 and for reducing noise radiation out of the cavity 26 through the steps 12.

The disclosed arrangement is capable of reducing noise levels in the, vicinity of a passenger conveyor system even when the machine is supported in the rise portion of an escalator structure because it reduces noise radiation in both directions (i.e., from the steps 12 into the cavity 26 and from the cavity 26 through the steps 12). The sound barrier material 40 blocks the radiated noise associated with step vibrations, machine operation or a combination of them.

In one example, the entire inner surfaces 42 and 44 are covered by the sound barrier material 40. In another example, at least some of the inner surface 42 of the tread portion 30 and at least some of the inner surface 44 of the riser portion 32 are covered by the sound barrier material 40. The extent of coverage and the manner in which the sound barrier material 40 is secured in place covering the inner surfaces of the step may be selected to meet the needs of a particular situation. Those skilled in the art who have the benefit of this description will realize how best to arrange the sound barrier material 40 to meet their particular needs.

One example arrangement for securing the sound baiter material 40 in place is shown in FIGS. 4A and 4B. In this example, a securing member is formed as a hook 50, which is part of the step structure. The sound barrier material 40 in this example includes a plurality of mounting features, which in this example are holes 52. Reinforcement members, which are grommets 54 in this example, reinforce the sound barrier material 40 in the vicinity of the holes 52. Each grommet 54 and hole 52 is received over a corresponding hook 50 so that the sound barrier material 40 is effectively hung on a corresponding portion of the step 12. This is also shown in FIG. 3.

Figure 5:
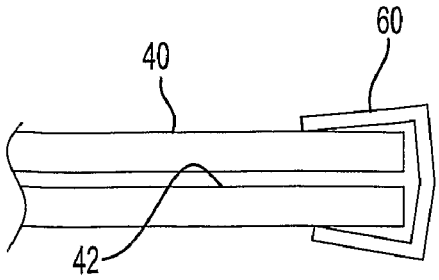
FIG. 5 schematically illustrates another arrangement for securing an acoustic barrier to a portion of a passenger conveyor step.

FIG. 5 illustrates another example arrangement where a clamp 60 is used to secure a portion of the sound barrier material 40 against a corresponding portion of the step structure. Clamps 60 are also used in the example of FIG. 3.

Figure 6:
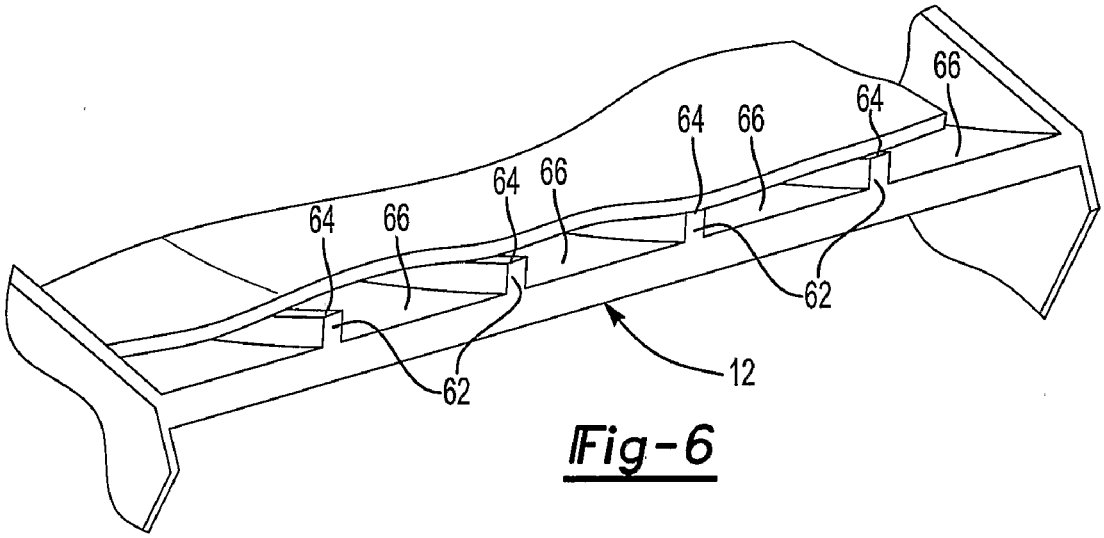
FIG. 6 schematically illustrates another arrangement for securing an acoustic barrier to a passenger conveyor step.

FIG. 6 schematically illustrates another arrangement where a plurality of reinforcing ribs 62 are formed on the inner surface 42 of an example tread portion 30. An adhesive 64 secures the sound barrier material 40 to the ribs 62. Commercially available adhesives that are suitable for use with the materials selected for forming the step and the sound barrier material are known. This arrangement leaves air gaps 66 between some of the inner surface 42 and the sound bander material 40. The presence of air gaps 66 is useful for enhancing the noise reducing capacity of the sound barrier material 40.

Figure 7:
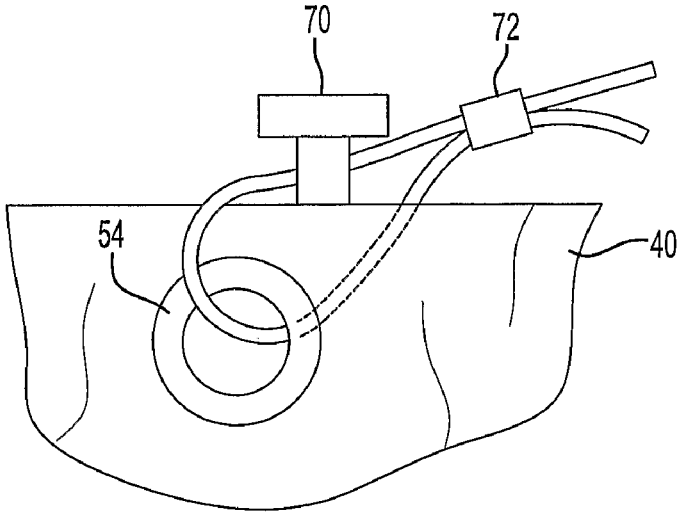
FIG. 7 schematically illustrates another arrangement for securing an acoustic barrier to a passenger conveyor step.

FIG. 7 illustrates another arrangement where a portion of the step structure shown at 70 has a shape that allows a securing member, which is a tie 72 in this example, to secure a corresponding portion of the sound barrier material 40 to the step 12. In this example, the tie 72 comprises a zip tie that allows for securely positioning a corresponding portion of the sound barrier material 40 in place so that the sound barrier material 40 covers over the desired amount of the corresponding inner surface of the step.

Figure 8:
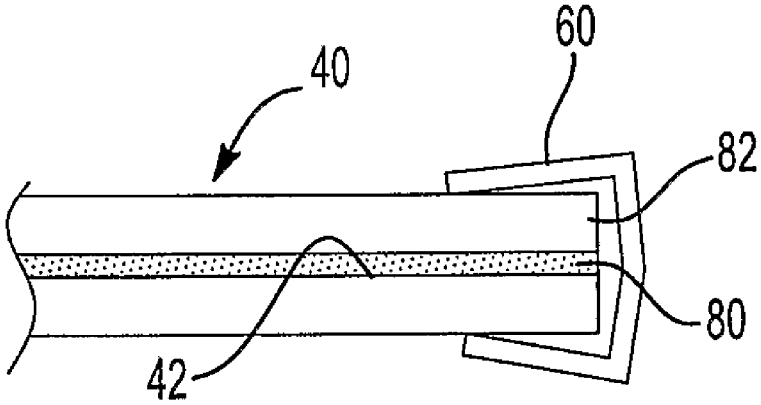
FIG. 8 schematically illustrates another arrangement including an acoustic barrier with a foam layer.

FIG. 8 schematically illustrates another arrangement where the barrier material 40 comprises a composite of a layer of acoustic foam 80 and a layer of vinyl shown at 82. The foam 80 is secured to the step inner surface 42 by adhesive in one example. Commercially available adhesives that are suitable for use with the materials selected for forming the step and the sound barrier composite material are known. This arrangement uses the foam 80 as spacer between the inner surface 42 and the dead material (i,e., the vinyl 82) of the sound barrier material 40. A foam spacer 80 is C useful for enhancing the noise reducing capacity of the sound barrier material 40.

Figure 9:
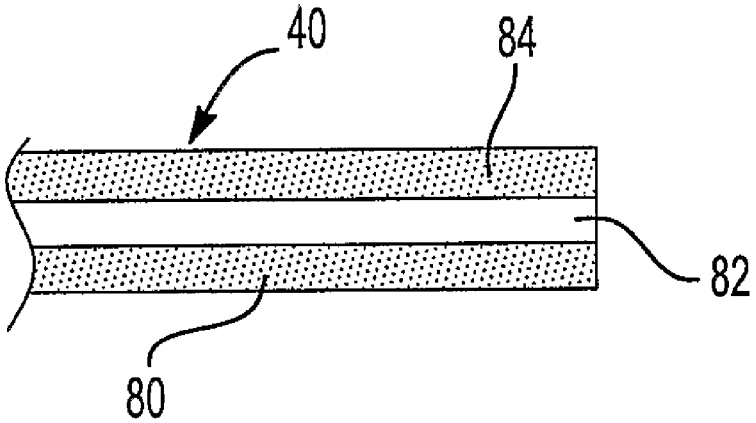
FIG. 9 schematically illustrates another acoustic barrier having an outer layer of foam on two sides.

FIG. 9 schematically illustrates another arrangement where the barrier has foam 80, 84 on both sides of a sheet of vinyl 82. The foam on the step side can be secured to the step inner surface 42 by an adhesive, for example. This arrangement uses the foam as spacer between the inner surface 42 and the vinyl layer 82 of the sound barrier material 40. The foam on the opposite side faces toward the cavity 26 and acts as a sound absorber to further reduce the noise level within the escalator cavity 26.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

I claim:

1. A passenger conveyor step, comprising:

a tread portion having an outer surface adapted to face toward a passenger and an inner surface facing in a generally opposite direction from the outer surface;

a riser portion extending away from the tread portion and having an outer surface and an inner surface; and a sound barrier material covering at least some of the inner surface of the tread portion and at least some of the inner surface of the riser portion.

2. The step of claim 1, wherein the sound barrier material covers substantially all of the inner surfaces.

3. The step of claim 1, wherein the sound barrier material comprises at least one sheet of acoustic barrier material.

4. The step of claim 3, wherein the sound barrier material comprises a sheet of vinyl.

5. The step of claim 3, wherein the sound barrier material comprises at least one layer of foam against at least one side of the sheet.

6. The step of claim 5, including foam on both sides of the sheet.

7. The step of claim 1, wherein the sound barrier material is received directly against at least a portion of each of the inner surfaces.

8. The step of claim 7, wherein the sound barrier material is at least partially spaced from at least a portion of one of the inner surfaces.

9. The step of claim 1, wherein the sound barrier material includes at least one mounting feature and including at least one securing member that secures the mounting feature in a desired position relative to a corresponding one of the inner surfaces.

10. The step of claim 9, wherein the at least one securing member is formed as part of at least one of the inner surfaces.

11. The step of claim 9, wherein the securing member comprises a clamp.

12. The step of claim 9, wherein the securing member comprises a tie.

13. The step of claim 9, wherein the at least one mounting feature comprises at least one hole in the sound barrier material and including a reinforcing member associated with the hole for reinforcing the material near the hole.

14. A method of controlling sound emission associated with a passenger conveyor system that has a plurality of steps each having a tread portion and a riser portion, each of the portions having an outwardly facing surface and an inner surface facing toward a cavity between the steps, comprising:

covering at least some of the inner surfaces of at least one of the tread portions or riser portions with a sound barrier material to thereby reduce sound radiation from the steps into the cavity.

15. The method of claim 14, including using a sheet of acoustic barrier material for covering the inner surfaces.

16. The method of claim 14, including using a sheet of vinyl for covering the inner surfaces.

17. The method of claim 14, including covering the inner surfaces of the tread portions and inner surfaces of the riser portions.

18. The method of claim 14, including placing at least some of the sound barrier material directly against the inner surfaces.

19. The method of claim 18, including leaving a spacing between at least some of the sound barrier material and the inner surfaces.

20. The method of claim 14, including covering the inner surfaces of the steps to thereby reduce sound radiation from the cavity and through the steps away from the outwardly facing surfaces.

21. A passenger conveyor, comprising:

a plurality of steps arranged to travel around a loop with a cavity defined between inner sides of steps on opposite sides of the loop, each of the steps including a tread portion having a corresponding inner side and a riser portion having a corresponding inner side;

a drive machine for propelling the steps around the loop; and a sound barrier material covering at least some of the inner sides of at least some of the tread portions or at least some of the riser portions of the steps such that the sound barrier material reduces sound radiation from the steps toward the cavity.

22. The passenger conveyor of claim 21, wherein the sound barrier material comprises at least one sheet of vinyl.

23. The passenger conveyor of claim 21, wherein the sound barrier material covers substantially all of the inner sides of all of the steps.

24. The passenger conveyor of claim 21, wherein the sound barrier material covers at least some of each of the inner sides of the riser portions and the tread portions of each of the steps.

* * * * *